US005369843A

United States Patent [19]

Yu

[11] Patent Number: 5,369,843

[45] Date of Patent: Dec. 6, 1994

[54] GRAVITY LOCKING ARTICULATION FOR A BRIEFCASE

[76] Inventor: Johnson C. T. Yu, Suite 1, 11F, No. 95-8, Chang Ping Road. Sec 1., Taichung, Taiwan, Prov. of China

[21] Appl. No.: 128,231

[22] Filed: Sep. 29, 1993

[51] Int. Cl.[5] ..... E05D 11/10

[52] U.S. Cl. ..... 16/346; 16/343

[58] Field of Search ..... 16/346, 343; 217/60 E

[56] References Cited

U.S. PATENT DOCUMENTS 4,114,235 9/1978 Remington ..... 16/346

FOREIGN PATENT DOCUMENTS 1343446 10/1963 France ..... 16/346

*Primary Examiner*—P. Austin Bradley

*Assistant Examiner*—Chuck Y. Mah

[57] ABSTRACT

A gravity locking articulation for a briefcase comprises a first and second cam plates disposed between hingedly connected ends of support links of the briefcase, and a sphere rollingly disposed within a generally annular race defined between the cam plates. The cam plates are fixed to respective links so as to rotate in opposite directions during opening of the briefcase. When the briefcase is in a vertical position the sphere is intromitted into a receiving pocket defined by spaces in the respective cam plates when the spaces are brought into registry. Stop surfaces in the respective cam plates to either side of the receiving pocket come into abutment with the sphere to stop further outward rotation of the links, with the frame members of the briefcase being spread only partially. Inward closure of the frame members is unimpeded.

3 Claims, 7 Drawing Sheets

GRAVITY LOCKING ARTICULATION FOR A BRIEFCASE

BACKGROUND OF THE PRESENT INVENTION

The present invention relates to an articulation for use with the support links found on the structures of conventional briefcases and the like, and more particularly to an articulation which adapts to the gravitational direction such as to prevent a complete opening of the briefcase when in a vertical position.

Conventional structures of briefcases, attaché cases, and even some suitcases normally incorporate a pair of connected links at the interior of either lateral side where they are connected on their free ends to the respective frames of the structure. Their major purpose is to support the top frame when raised to a near vertical position over the hingedly connected lower frame which rests against a horizontal surface. Ordinarily, it would be very inconvenient if the briefcase where to open inadvertently when in a vertical position, as there would be no restraints to prevent the top frame from swinging fully open and spilling the contents held within. Likewise, should a user attempt to place or extract articles in the briefcase with one hand while the briefcase is dangling from the other, the task would be clumsy if not unachievable with conventional structures.

The novel modifications of the present invention overcome these limitations by providing an articulation which reacts to the gravitational orientation of a briefcase to prevent a complete opening whether due to accident or intent.

SUMMARY OF THE PRESENT INVENTION

The gravity locking articulation for briefcases comprises a first and second disc like cam plates fixed respectively to the hingedly connected ends of links supporting each side of a briefcase. The plates are juxtaposed between the connected ends and define a generally annular race therein in which a sphere is rollingly disposed. The sphere is urged by gravity towards a lowermost position in the race, whereat when the briefcase is opened from a vertical position the sphere is wedged between two stop surfaces defined by the respective plates after the links are spread outward by a predetermined angle. The top frame of the briefcase will thus be arrested before spillage of the briefcase's contents can occur, while a user can still move the top frame back against the major lower frame of the briefcase.

It is accordingly an object of the present invention to provide a briefcase structure which aids in preventing spillage of the briefcase's contents due to inadvertent opening from a vertical position.

A further object of the present invention is to provide a briefcase structure which facilitates the placement and extraction of articles in the briefcase while in a vertical position, as when suspended from a user's hand.

A yet further object of the present invention is to provide a releasable securement for maintaining a briefcase in a fully open position that is more reliable and firm than that which is usually provided by a simple linkage support.

A more thorough understanding of the actualization of these objects of the present invention will be rendered after referring to a detailed description of a preferred embodiment thereof, provided below along with accompanying drawings.

DETAILED DESCRIPTION OF THE PREFERRED EMBODIMENT

Figure 1:
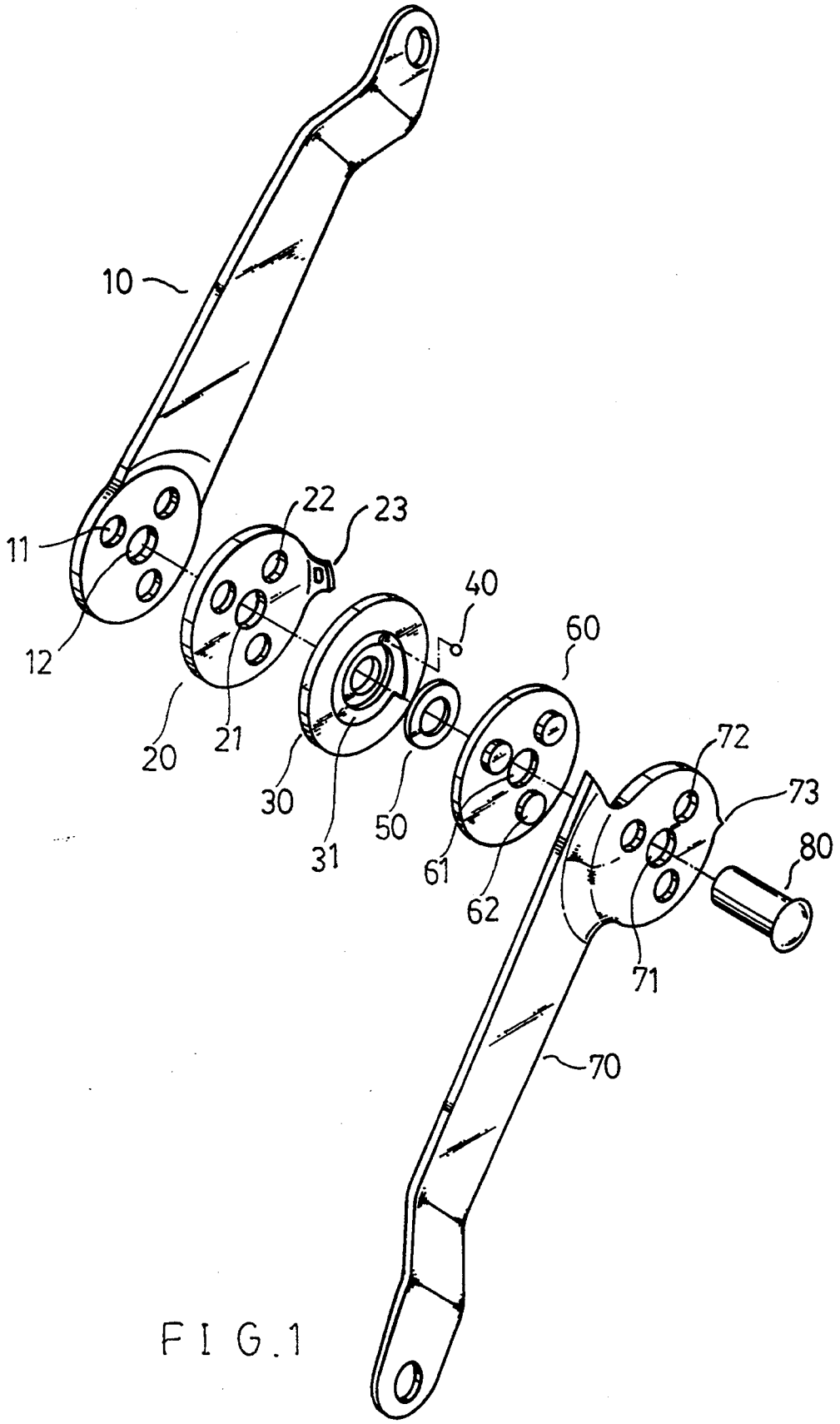
FIG. 1 is an exploded view of the gravity locking articulation and associated links.
Figure 3:
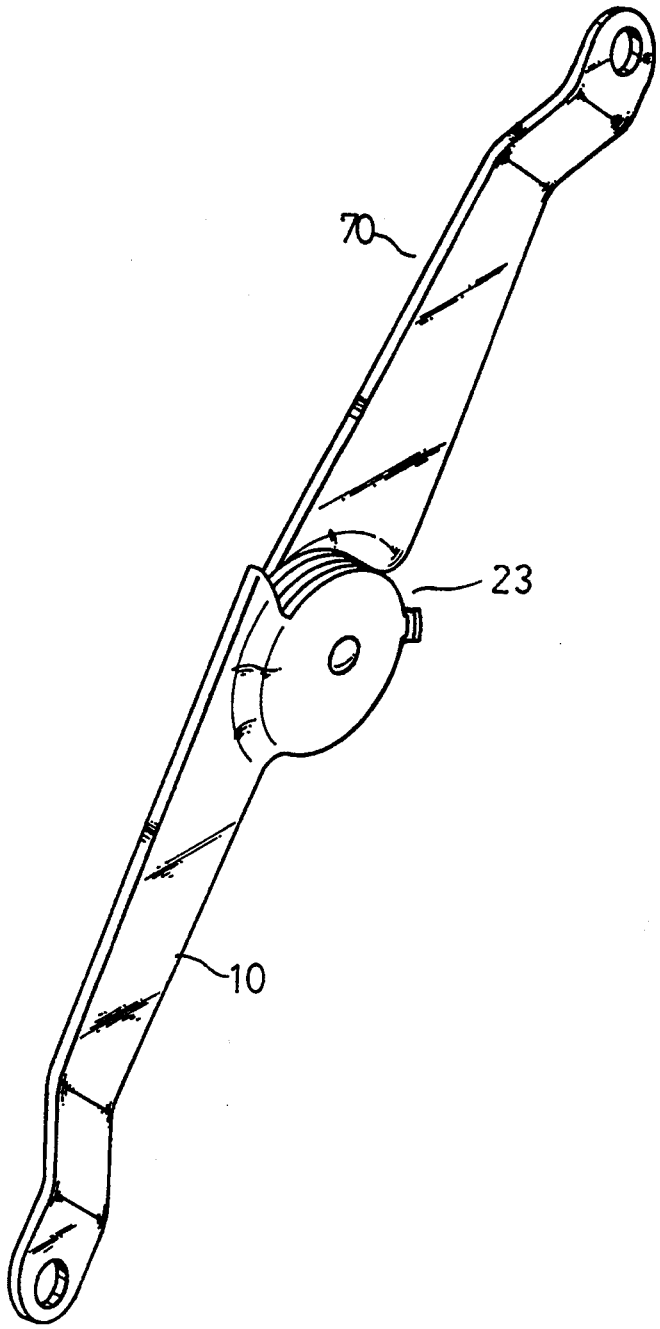
FIG. 3 is an assembled view of the articulation with associated links at a fully spread position.

Referring to FIG. 1 of the drawings, a preferred embodiment of the gravity locking articulation comprises a generally disc shaped first cam plate 30 and second cam plate 60 of diecast metal. A hardened sphere 40, such as a ball bearing is disposed between the cain plates, as is an annular friction reducing spacer 50. An elongate first link 70 and second link 10 of pressed metal are hingedly connected about respective second end portions thereof by a rivet 80 which passes through respective through holes 71, 12 thereon. Cam plates 30, 60 are disposed between the second end portions of the links. FIG. 3 shows the assembled mechanism.

Figure 2A:
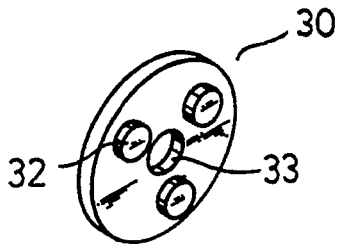
FIG. 2*a* is a perspective view showing a rear side of a second cam plate of the articulation.

The second cam plate is fixedly coupled to link 10 via a set of protrusions 32, shown in FIG. 2*a*, which pass into corresponding receiving holes 11 in the second end portion of the link. A generally disc shaped stop plate 20 having a corresponding set of holes 22 for the passage of protrusions 32 is disposed between the first link and cam plate 30. Both the stop plate and second cam plate have central, aligned through holes 21 and 31, respectively, for the passage of rivet 80. Similarly, the rear side of first cam plate 60 has a set of protrusions 62 which occupy corresponding holes 72 in the second end portion of link 70 so as to be fixed thereto.

Figure 2B:
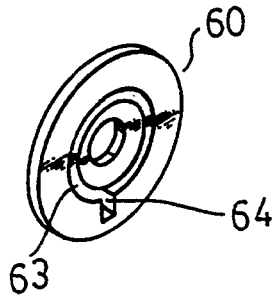
FIG. 2*b* is a perspective view showing a front side of a first cam plate of the articulation.

Referring to FIG. 2*b*, the front side of cam plate 60 has an annular recess 63 thereon concentric with hole 61. A slot 64 extends radially therefrom at a predetermined angular position. Cam plate 30, as shown in FIG. 1, has a recessed portion 31 which is juxtaposed with the annular groove. The space therebetween defines a generally annular race in which sphere 40, which has a diameter equal with the combined depths of the annular recess and recessed portion 31, is rollingly disposed.

Figure 4A:
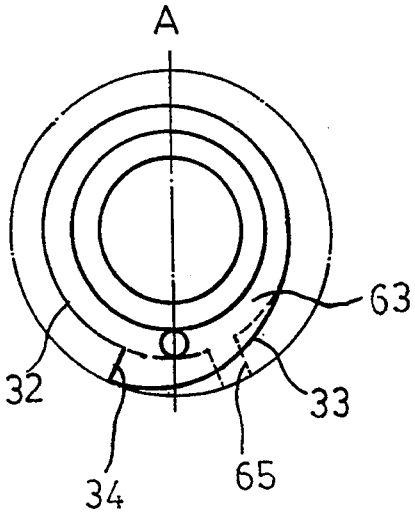
FIG. 4*a* is a phantom view of a gravity locking mechanism of the articulation when in the position of FIG. 4.
Figure 4:
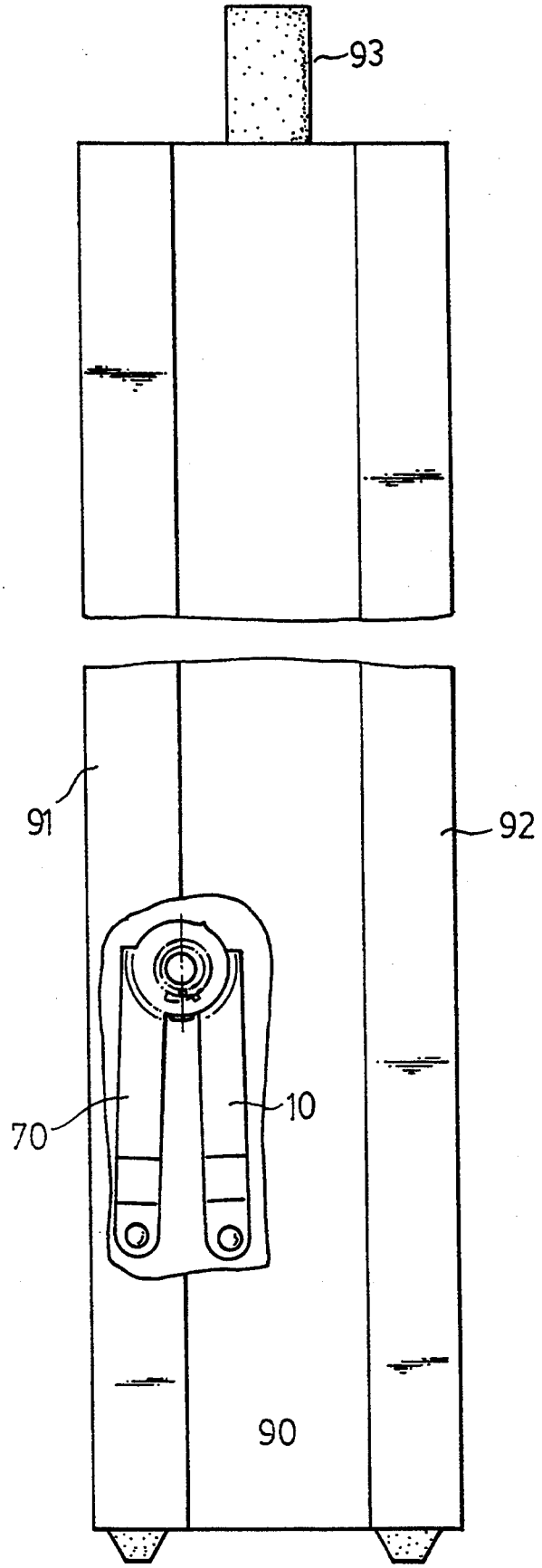
FIG. 4 is a partly sectional view of a briefcase showing the arrangement of the articulation therein when in a vertical position.

Referring to FIG. 4, the recessed periphery of the recessed portion 31 defines a semicircular sector 32 having a radius equal with that of the outer periphery of annular groove 63, and a tangentially adjoining spiral sector 33. A radially aligned stop surface 34 adjoins the free end of the semicircular sector with that of the spiral sector whereat it is of maximum radius. The radially extending side of slot 64 which faces first stop surface 34 defines a second stop surface 65 of nearly equal radial extent.

As shown in FIG. 4*a*, the first ends of links 70, 10 are hingedly connected to respective frames 91, 92 of a briefcase 90 at predetermined positions on corresponding lateral sides thereof. The links are at their minimum angular separation when frame 91 is positioned against frame 92, i.e., the briefcase is in a closed position. When the links are at this angular position and the briefcase is in a vertical position, as when suspended from a handle 93, the stop surfaces 34 and 65 assume acute angles with respective sides of a vertical plane A coincident with the hinge axis of the connected links. Further, sphere 40 is urged by gravity to the lowermost point of the race where it is also coincident with the vertical plane.

Figure 5:
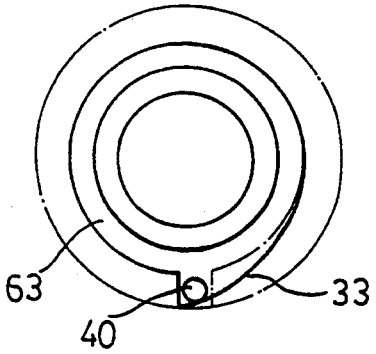
FIG. 5 is a phantom view of the gravity locking articulation when in the position of FIG. 4.
Figure 5A:
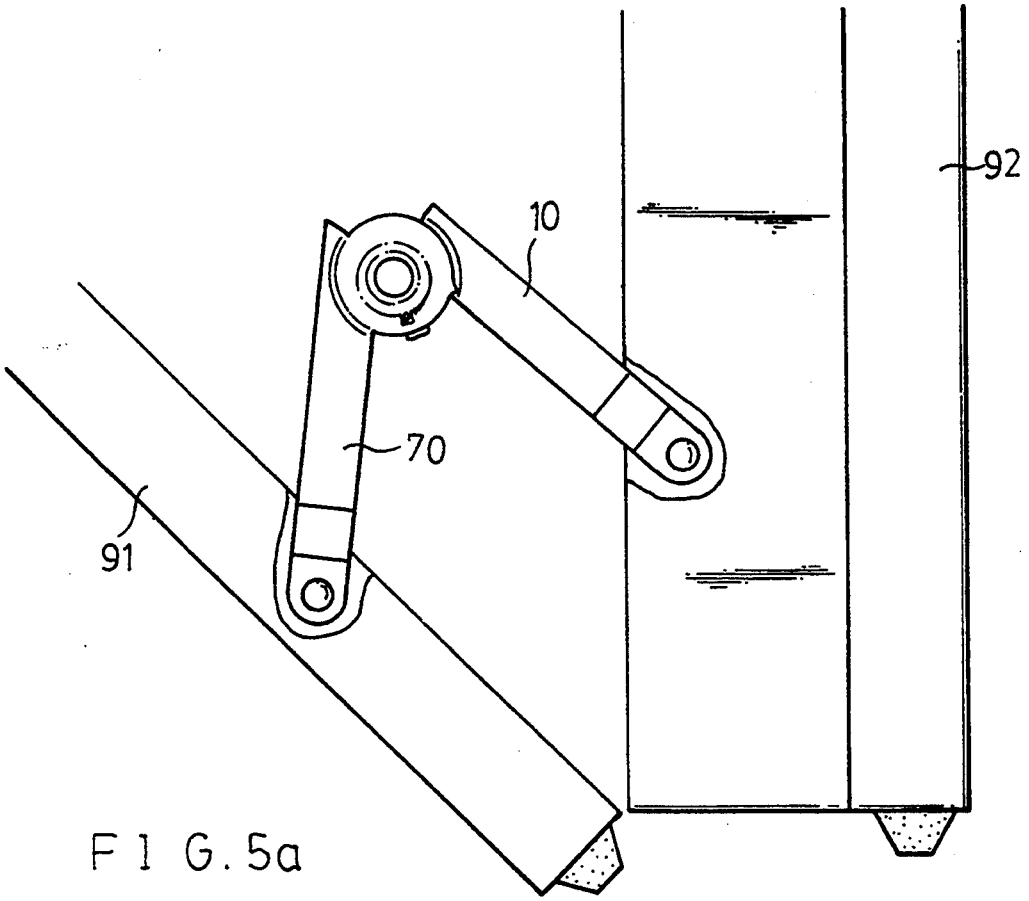
FIG. 5*a* is a partly sectional view of the briefcase as in FIG. 4 with the frame members thereof swung open to a locking position.

When frame 91 is swung away frown frame 92 the links spread apart so that slot 64 approaches stop surface 34. A space adjacent stop surface 34 and the adjoining periphery of the spiral sector, and that within slot 64 define a receiving pocket when brought into registry. Referring to FIG. 5 and 5*a*, when the frames of the briefcase are swung apart from a vertical position, sphere 40 is intromitted into the receiving pocket whereafter the bordering stop surfaces 34, 65 come into abutment against the sphere to prevent further spreading of the links, so that frame 91 is only partially swung out from frame 92 by an acute angle. Frame 91 can, however, be swung in an opposite direction towards frame 92, wherein the spiral sector 33 acts as a ramp and urges the sphere out of slot 64 and back into the annular groove.

Figure 6:
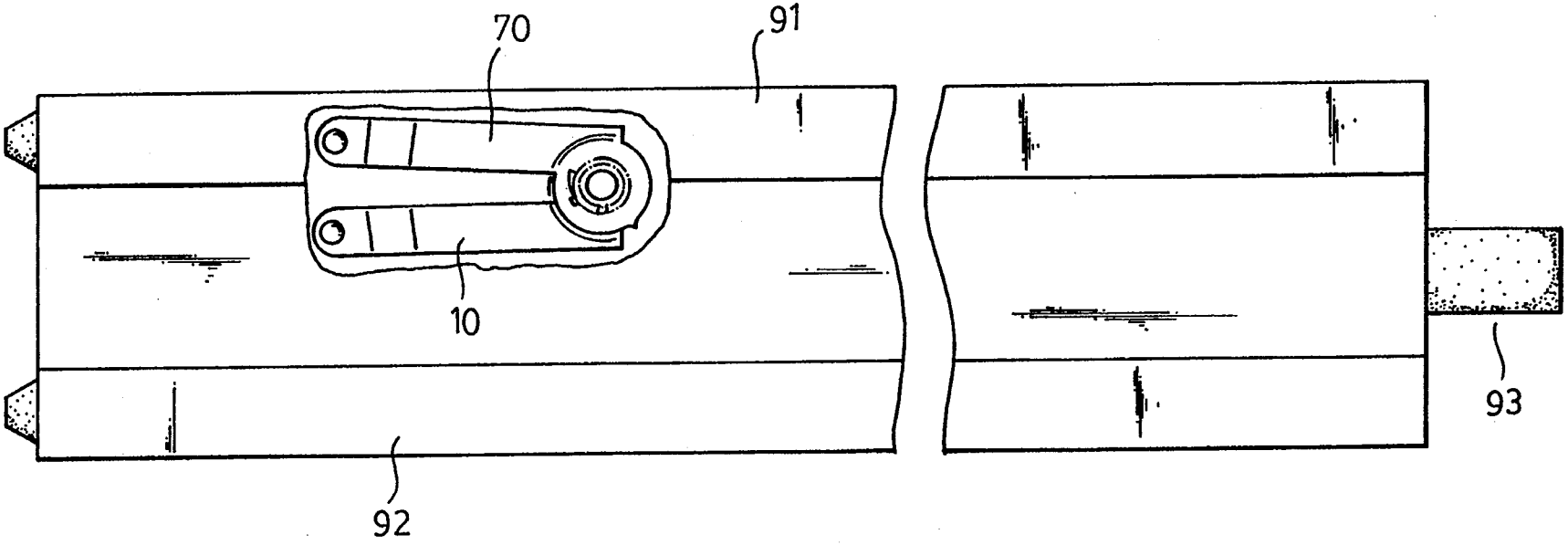
FIG. 6 is a partly sectional view of the briefcase showing the arrangement of the articulation when in a horizontal position.
Figure 7:
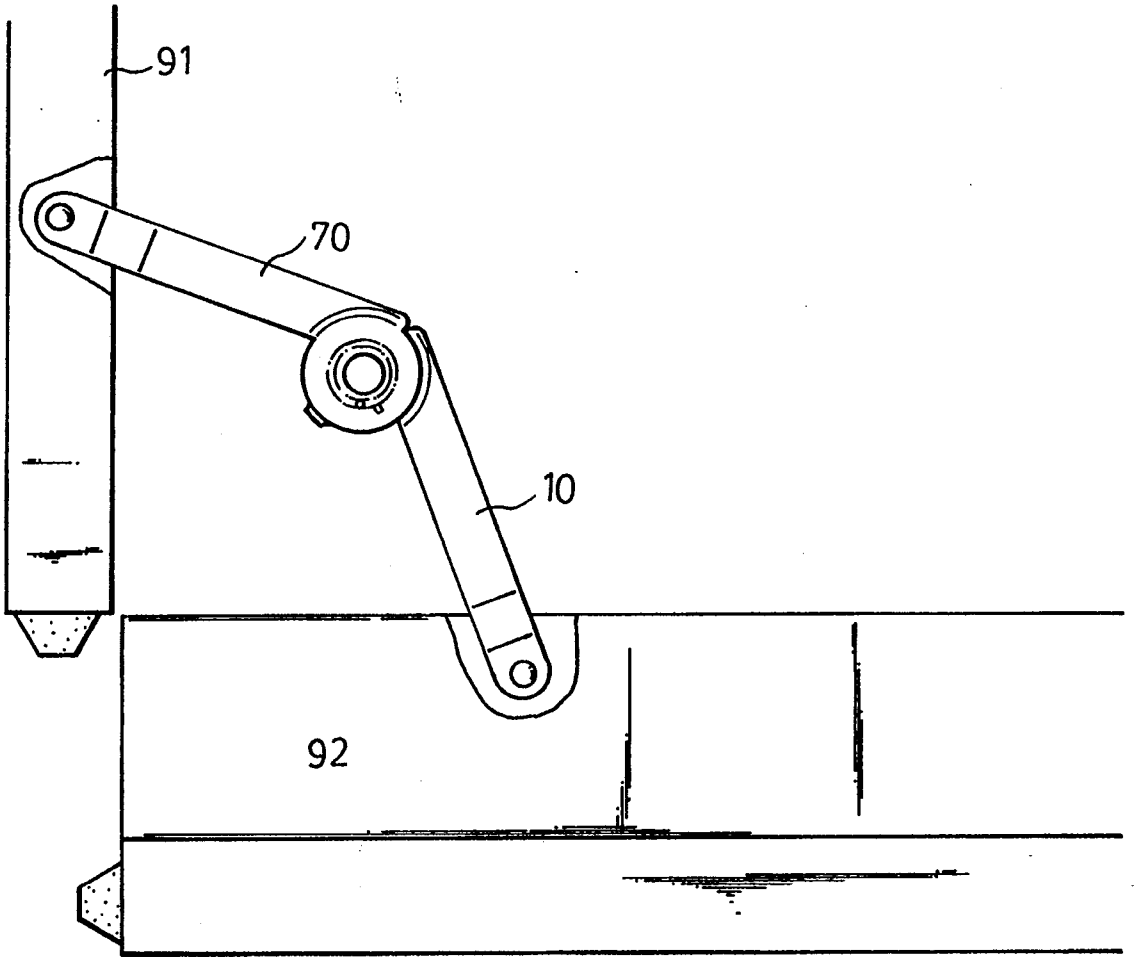
FIG. 7 is a partly sectional view of the briefcase as in FIG. 5 with the frame members swung to a fully open position.

Conversely, when the briefcase is in a horizontal position, as in FIG. 6, the sphere 40 is disposed around the two stop surfaces, with slot 64 located between the sphere and stop surface 34. As such, the sphere is not intromitted into receiving pocket to be engaged by the stop surfaces. The briefcase can thus be brought to a fully open position wherein frame 91 is near perpendicular with frame 92, as shown in FIG. 7.

Referring again to FIGS. 1 and 3, an apertured resilient catch 23 on the periphery of stop plate 20 extends perpendicularly therefrom across the rounded periphery of the second end portion of link 70. The resilient catch engages a radially protruding stop 73 on the rounded periphery of the link when the links are pivoted into a fully spread position, wherein the catch flexes outward and recovers to intromit the tip of stop 73 through the aperture so as to releasably secure the position of the briefcase frames.

The gravity locking articulation of the present invention can thus protect a user from accidental spillage of his or her briefcase's contents should the lock mechanism be defective or the user had forgotten to engage it. Additionally, along with a cooperating release mechanism a briefcase so provided would facilitate placement and extraction of articles therein from a vertical position. This would be a necessary operating position when a suitable horizontal support surface is unavailable or during transport in a crowded environment. With more conventional briefcase structures these operations would be inconvenient at best. A briefcase incorporating the gravity locking articulation would thus be of greater utility and convenience.

Further, many modifications to and variations of the present invention could be readily accomplished by a person of average skill in the art to best suit the needs and requirements of design and manufacture without departing from scope thereof. As such, the actual spirit and scope of the present invention should not be deemed to be limited to the specificities of the above disclosure but instead be determined from the appended claims and their legal equivalents.

I claim:

1. A gravity locking articulation for a briefcase characterized in having a generally rectangular first shell and second shell hingedly connected along corresponding rear sides thereof, a pair of elongate first links of predetermined length hingedly connected on a first end thereof to respective lateral sides of said first shell at predetermined positions thereon, and a pair of elongate second links of predetermined length hingedly connected on a first end thereof to respective lateral sides of said second shell at predetermined positions thereon, a second end of each said first links being hingedly coupled to a second end of an associated said second links, wherein said gravity locking articulation comprises:

a first cam plate fixed on the second end of each said first links between said first links and associated said second links, and having;

a) a recessed annular groove concentric with the hinge axis of the coupling between said first links and said second links;

b) a recessed slot extending radially outward from the annular groove; and c) a first stop surface defined by a radially extending side of the recessed slot, the first stop surface assuming a predetermined acute angle with respect to a first side of a vertical plane coincident with the hinge axis of the coupling between said first links and said second links when said briefcase is in a closed vertical position as when depending from a handle thereon:

a second cam plate fixed on the second end of each said second links adjacent an associated said first cam plate, and having a recessed portion with a recessed periphery thereof defining;

a) a first sector of semicircular form concentrically juxtaposed with the annular groove of said first cam plate so as to define a generally annular race therebetween, and having a radius substantially equal with that of the outer periphery of the annular groove of said first cam plate:

b) a second sector of radially expanding form adjoining tangentially with the first sector; and c) a second stop surface extending radially from the free termination of the first sector to the point of maximum radial extent of the second sector and facing the first stop surface, the second stop surface assuming a predetermined acute angle with respect to a second side of the vertical plane coincident with the hinge axis of the coupling when said briefcase is in a closed vertical position;

wherein, the first stop surface approaches the mutually revolving second stop surface upon an opening of said briefcase, with a first space in the recessed slot of said first cam plate and a second space adjacent the second stop surface and second sector of said second cam plate defining a receiving pocket when brought into registry, the receiving pocket being bordered by the first stop surface mid the second stop surface;

a roller element rollingly disposed in the race between said first cam plate and said second cam plate and having a width substantially equal with the combined depths of the annular groove of said first cam plate and the recessed portion of said second cam plate, said roller element being urged by gravity to assume a lowermost position in the race, whereat said roller element is disposed between the first stop surface and the second stop surface when said briefcase is in a closed vertical position, and around the first stop surface and the second stop surface when said briefcase is in a horizontal position;

whereby, when said first shell is pivoted a predetermined angle away front said second shell with said briefcase in a vertical position said roller element is intromitted into the receiving pocket and wedged between the first stop surface and the second stop surface preventing further outward rotation of said first shell with respect to said second shell, whereas when said first shell is pivoted away frown said second shell with said briefcase in a horizontal position said roller element is not engaged within the receiving pocket allowing a full opening of said briefcase.

2. A gravity locking articulation as in claim 1, further comprising:

at least one protrusion on a side of each said first cam plate and each said second cam plate opposite from the respective annular groove and recessed portion thereof;

at least one receiving space in the second end of each said first links and each said second links engaging a corresponding said at least one protrusion of respective said first cam plate and said second cam plate, and a through hole extending through the second end of each said first links and associated said second links, and through associated said first cam plate and said second cam plate therebetween:

a mechanical fastener extending through said through hole and hingedly coupling each said first links with an associated said second links, and securing associated said first cam plate and said second cam plate therebetween.

3. A gravity locking articulation as in claim 2, further comprising:

a stop plate disposed between each said second cam plate and associated said second links having at least one hole therein for the passage of a corresponding said at least one protrusion of said second cam plate;

a resilient catch at a predetermined position on the periphery of said stop plate, said resilient catch extending perpendicularly therefrom across a periphery of the second end portion of an associated said second links:

a radially protruding stop at a predetermined position on the periphery of the second end portion of each said second links engaging an associated resilient catch to releasably secure the position of said first shell with respect to said second shell when said briefcase is fully open.

* * * * *